US006253039B1

(12) United States Patent
Nakano et al.

(10) Patent No.: US 6,253,039 B1
(45) Date of Patent: Jun. 26, 2001

(54) COLOR IMAGE FORMING APPARATUS

(75) Inventors: Masahiro Nakano, Hitachi; Masahiko Saito, Kitaibaraki; Akira Sasaki; Kazuhiro Wakamatsu, both of Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/460,518

(22) Filed: Dec. 14, 1999

(30) Foreign Application Priority Data

Dec. 15, 1998 (JP) ..... 10-356035

(51) Int. Cl.[7] ..... G03G 15/16; G03G 15/01

(52) U.S. Cl. ..... 399/53; 399/43; 399/45; 399/66; 399/101; 399/302

(58) Field of Search ..... 399/66, 53, 81, 399/223, 302, 298, 101, 43, 45, 82

(56) References Cited

U.S. PATENT DOCUMENTS 5,671,464 * 9/1997 Kubota ..... 399/101
5,870,648 * 2/1999 Sakaki et al. ..... 399/66
5,970,278 * 10/1999 Munakata ..... 399/66 X

FOREIGN PATENT DOCUMENTS 5-061339 * 3/1993 (JP) .

* cited by examiner

*Primary Examiner*—Sophia S. Chen
(74) *Attorney, Agent, or Firm*—Antonelli, Terry, Stout & Kraus, LLP

(57) ABSTRACT

A color image forming apparatus is capable of reducing color deviation of an image due to the influence of a variation in load of an intermediate transfer member and of carrying out high speed printing. A control unit for controlling an image forming process on the basis of the size of a recording medium sets, where a recording medium of a size smaller than the longest image length capable of forming a color image is subject to continuous image formation, a first mode for continuously carrying out a development process for forming a latent image and a toner image, and a second mode of incorporating a stop process for stopping the development process in the midst of the development process. This enables reduction of color deviation of an image caused by the influence of a variation in load of an intermediate transfer member and high speed printing also.

4 Claims, 5 Drawing Sheets

COLOR IMAGE FORMING APPARATUS

BACKGROUND OF THE INVENTION

The present invention relates to a color image forming apparatus, and, more particularly, to a color image forming apparatus which is capable of preventing deterioration of image quality caused by a variation in the load of an intermediate transfer member.

A typical image forming method for obtaining a color image provides for sequentially repeating the transfer of a plurality of toner images of different primary colors, color by color, from a latent image holding means to an intermediate transfer member, forming a plurality of superimposed color images on the intermediate transfer member, and then transferring the superimposed color images onto a recording medium to form a color image.

As an example of an image forming apparatus using an intermediate transfer member, as described above, there is an apparatus using a driven cylindrical drum as the intermediate transfer member, as disclosed in Japanese Patent Laid-Open No. Hei 1-198773. In the method using an intermediate transfer member, when the size of a recording medium is small, a plurality of images are simultaneously formed on the intermediate transfer member for speeding up image formation. However, in this method, external loads which are intermittently generated after completion of the formation of an image of the previous page of a plurality of sheets affect the image quality of an image of the next page during formation of an image at the same time.

It is necessary to remove residual toner on the intermediate transfer member after secondary transfer of the previous page to the recording medium and before the primary transfer of the next page to the intermediate transfer member. Where a color image is formed on the intermediate transfer member by a plurality of primary transfers, a cleaning apparatus for removing residual toner is disposed apart from the intermediate transfer member for preventing interference relative to the toner image during formation of a color image, and the cleaning apparatus operates in contact therewith in an area of completion of secondary transfer to the recording medium. Because of this, the cleaning operation appears as an intermittent external load relative to the intermediate transfer member.

Further, in the case of using a secondary transfer means requiring pressurization to an intermediate transfer member, such as a transfer roller, and where a color image requiring a plurality of primary transfers is formed, the transfer roller or the like is disposed apart, during formation of color image, from the intermediate transfer member, and operates in contact therewith when secondary transfer takes place, which appears as an intermittent external load relative to the intermediate transfer member.

Where these external loads act intermittently on the intermediate transfer member, a variation in speed caused by the external load is generated in the intermediate transfer member, leading to a variation in speed of a photosensitive member operating as a latent image holding means. When primary transfer or secondary transfer of the next page is carried out at the time of variation in speed, a deviation in position occurs in an image, and a deviation of superposed toner images, called a color deviation, is generated by the positional deviation. This color deviation causes image quality to be deteriorated, making it difficult to obtain a desired image. Therefore, it is necessary to suppress a variation in load and a variation in speed, but the variation of the load itself cannot be eliminated, posing a great technical problem.

SUMMARY OF THE INVENTION

It is an object of the present invention to provide a color image forming apparatus which is capable of reducing a deviation of color of an image, resulting in a variation in load of an intermediate transfer member, and which is capable of carrying out high speed printing.

For achieving the aforesaid object, the color image forming apparatus according to the present invention is characterized in that, where a recording media having a size smaller than one half of the longest image length capable of forming a color image is continuously subject to image formation, a first mode of continuously carrying out a developing process for forming a latent image and a toner image and a second mode of employing a stop process for stopping the developing process in the midst of the developing process are set. Or, there are provided a normal mode and a highly fine mode, and there is provided a button for selecting either the normal mode or the highly fine mode. Or, there are provided a normal mode and a mode not performing the primary transfer when the second transfer takes place.

Preferably, the first mode is a high speed mode for carrying out the primary transfer of the next page of the recording medium during the secondary transfer of the previous page and cleaning, and the second mode is a high quality mode for carrying out the primary transfer of the next page of the recording medium after the secondary transfer of the previous page and cleaning.

Preferably, the second mode is a high speed and high quality mode for carrying out color image forming for a plurality of sheets of the size of said recording medium on the intermediate transfer member, deviating timing of the image forming time of a color for forming an image at last on and after a second page of said recording medium, and carrying out latent image formation of a color for forming an image of the next page at last and the primary transfer after completion of the secondary transfer of the previous page and cleaning.

Preferably, in the high speed mode, a plurality of sheets of color images of the size of the recording medium are formed on said intermediate transfer member, and in the high quality mode, a sheet of a color image of the size of said recording medium is formed on said intermediate transfer member.

EMBODIMENTS OF THE PRESENT INVENTION

The color image forming apparatus according to one embodiment of the present invention will be explained hereinafter with reference to the drawings.

Figure 1:
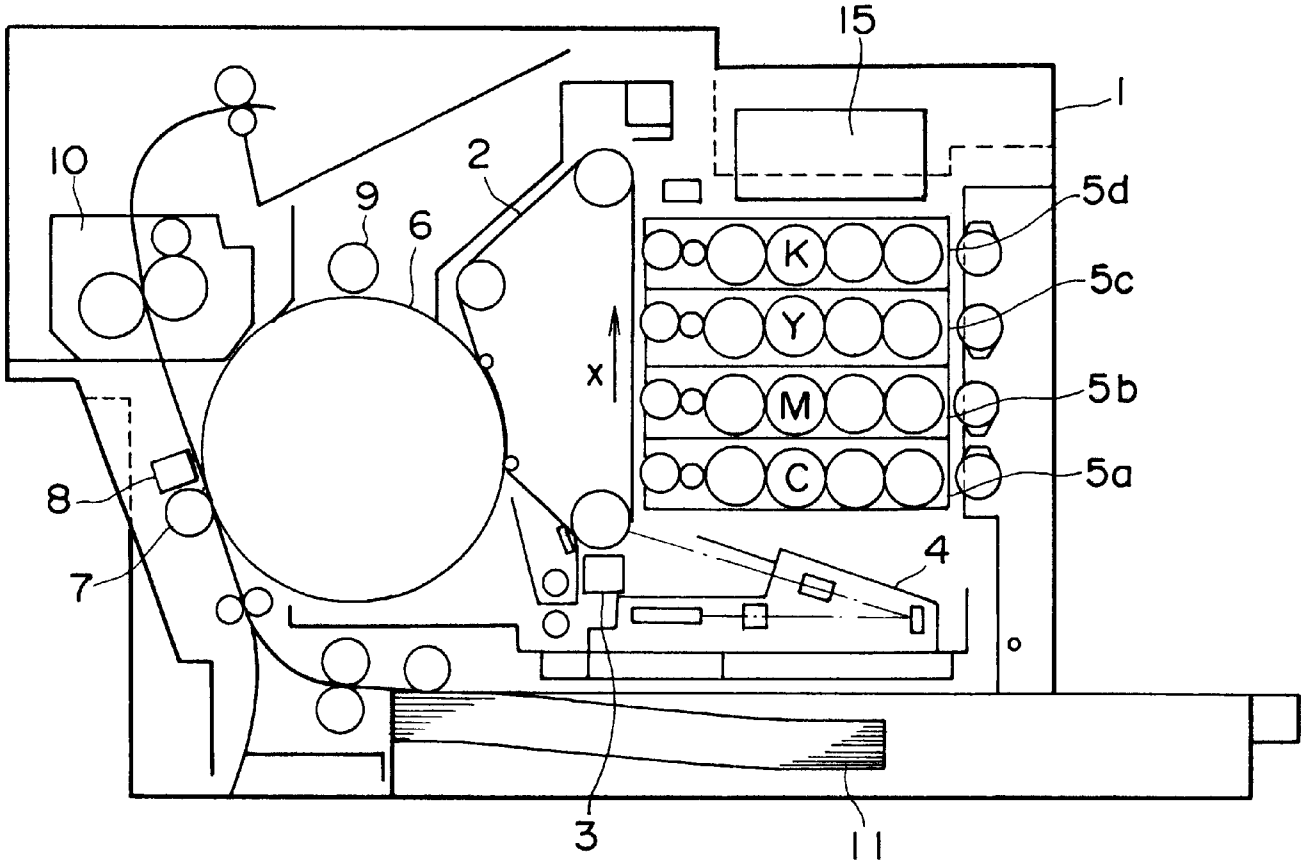
FIG. 1 is a longitudinal sectional view of an image forming apparatus according to one embodiment of the present invention.

FIG. 1 is a schematic view of an internal construction of a color laser printer representing a color image forming apparatus according to one embodiment of the present invention.

In the central portion of the main body 1 there is provided a photosensitive belt 2 stretched over five rotatable shafts. The photosensitive belt 2 can be moved in the direction indicated by the arrow X. In the vicinity of the photosensitive belt 2, there are provided a photosensitive charger 3, an exposure unit 4, development units 5*a*, 5*b*, 5*c*, 5*d*, an intermediate transfer member 6, and so on in order in the direction of the arrow X.

Around the intermediate transfer member 6 there are provided a cleaning unit 9, a recording medium peeling unit 8, a transfer roller 7 operating as a secondary transfer unit to a recording medium 11, and so on.

Further, there is provided a control unit 15 for controlling an image forming process on the basis of the size of the recording medium.

The photosensitive belt 2 rotates in the direction of the arrow X while being controlled at a constant speed in a state in which a fixed potential is applied to a conductive layer thereof. At this time, it is uniformly charged by the photosensitive charger 3, and then it is exposed by the exposure unit 4 in accordance with a color image signal.

The photosensitive belt 2 is changed in surface potential by exposure so that respective electrostatic latent images for the respective primary colors are formed sequentially. This latent image is developed by one of the development units 5*a*, 5*b*, 5*c*, and 5*d* associated with the respective colors to form toner images of the colors.

The toner images of colors formed on the photosensitive belt 2 are placed in primary transfer on the surface of the synchronously rotating intermediate transfer member 6 while it is in contact with the surface of the photosensitive belt 2. The intermediate transfer member 6 has a potential difference from the photosensitive belt so that toner is attracted from the surface of the photosensitive belt 2 to the surface of the intermediate transfer member 6.

The intermediate transfer member 6 is moved depending on the photosensitive belt 2 due to pressure, friction or the like.

The primary transfer of the toner image to the intermediate transfer member 6 is repeated plural times in correspondence to the number of colors, whereby a color image consisting of a plurality of superposed color toner images is formed-on the intermediate transfer member 6.

After the color image is formed on the transfer member 6, it is secondary-transferred on the surface of the recording medium 11 by the transfer roller 7 operating as the secondary transfer means.

The transfer roller 7 presses the recording medium 11 to the intermediate transfer member 6, and a voltage is applied thereto to secondary transfer a toner image onto the recording medium 11 by electric attraction and pressure. The transfer roller 7 is spaced from the intermediate transfer member 6 while a color image is formed on the intermediate transfer member 6 to prevent interference with the toner image, and operates in contact with the intermediate transfer member 6 only when secondary transfer to the recording medium 11 takes place.

After the secondary transfer from the intermediate transfer member 6 to the recording medium 11, the recording medium 11 is peeled from the intermediate transfer member 6 by the recording medium peeling unit 8, and the color image on the recording medium 11 is fixed by a fixing unit 10.

The cleaning unit 9 removes toner remaining on the intermediate transfer member 6 after secondary transfer from the intermediate transfer member 6 to the recording medium 11. The cleaning unit 9 is spaced from the intermediate transfer member 6 while a color image is formed on the intermediate transfer member 6 to prevent interference with the toner image, and operates in contact in an area where secondary transfer to the recording medium 11 has been completed to remove toner remaining on the intermediate transfer member 6.

Figure 2:
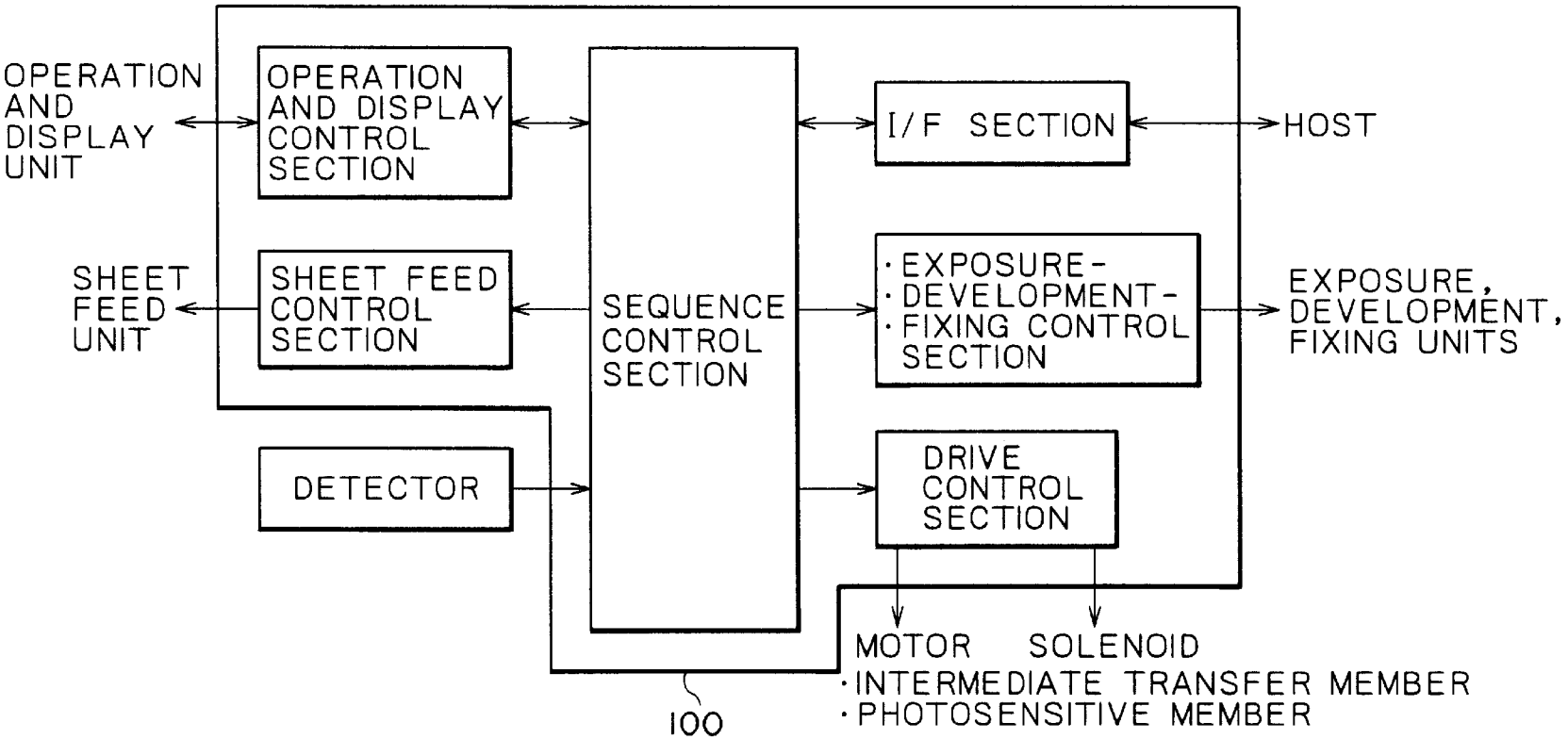
FIG. 2 shows a control block diagram.

FIG. 2 shows a control block diagram. A printer body control section 100 comprises an I/F section for delivery and reception of data to and from a host, exposure, development and fixing units, a motor as a power supply, a drive section for a solenoid, an operation and display control section, a sheet feed control section, a sequence control section for controlling some detectors or the like, and a sheet inversion control section.

Figure 3:
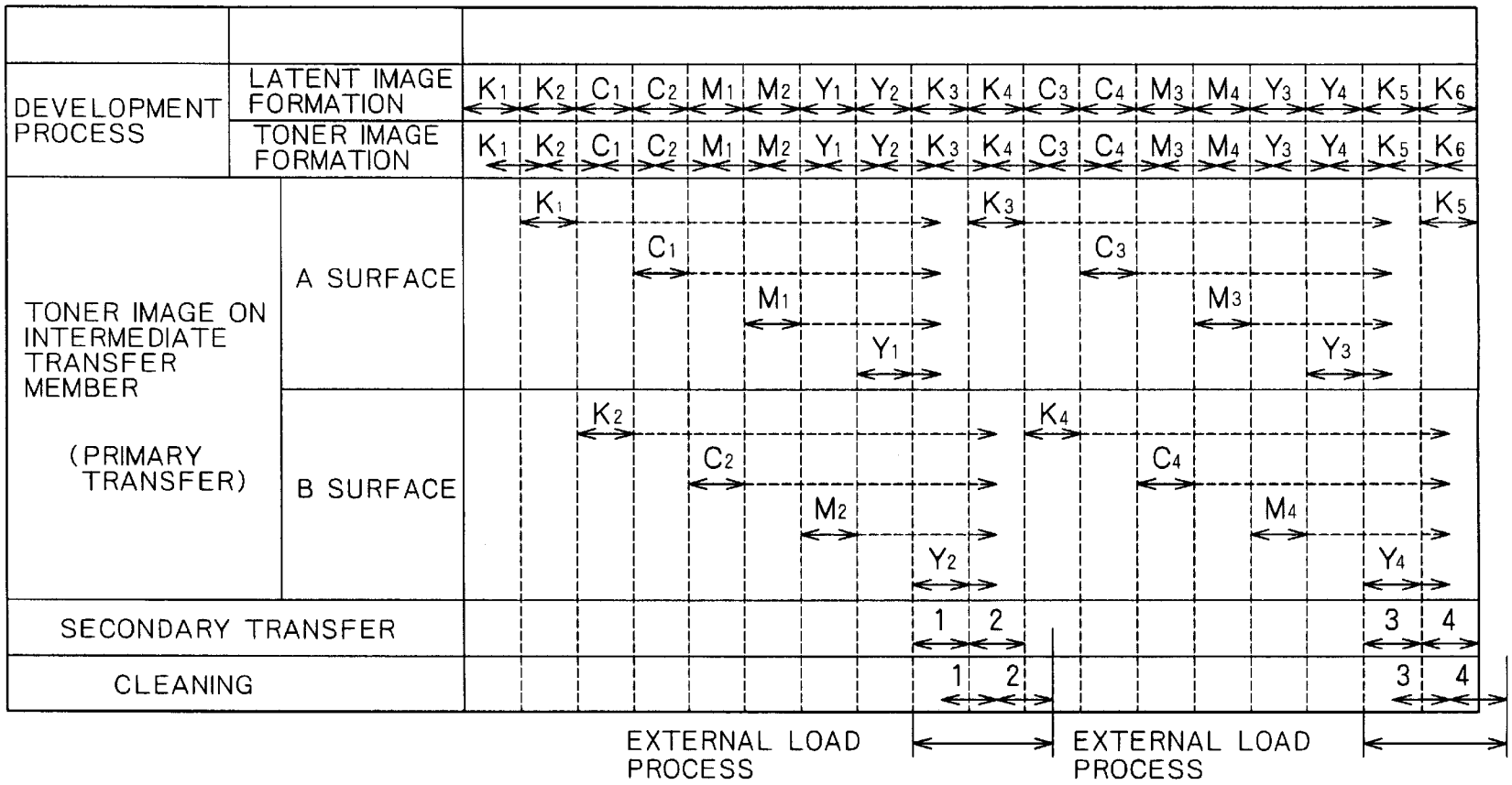
FIG. 3 is a time chart of a high speed mode when an image is formed by the color image forming apparatus of FIG. 1.
Figure 4:
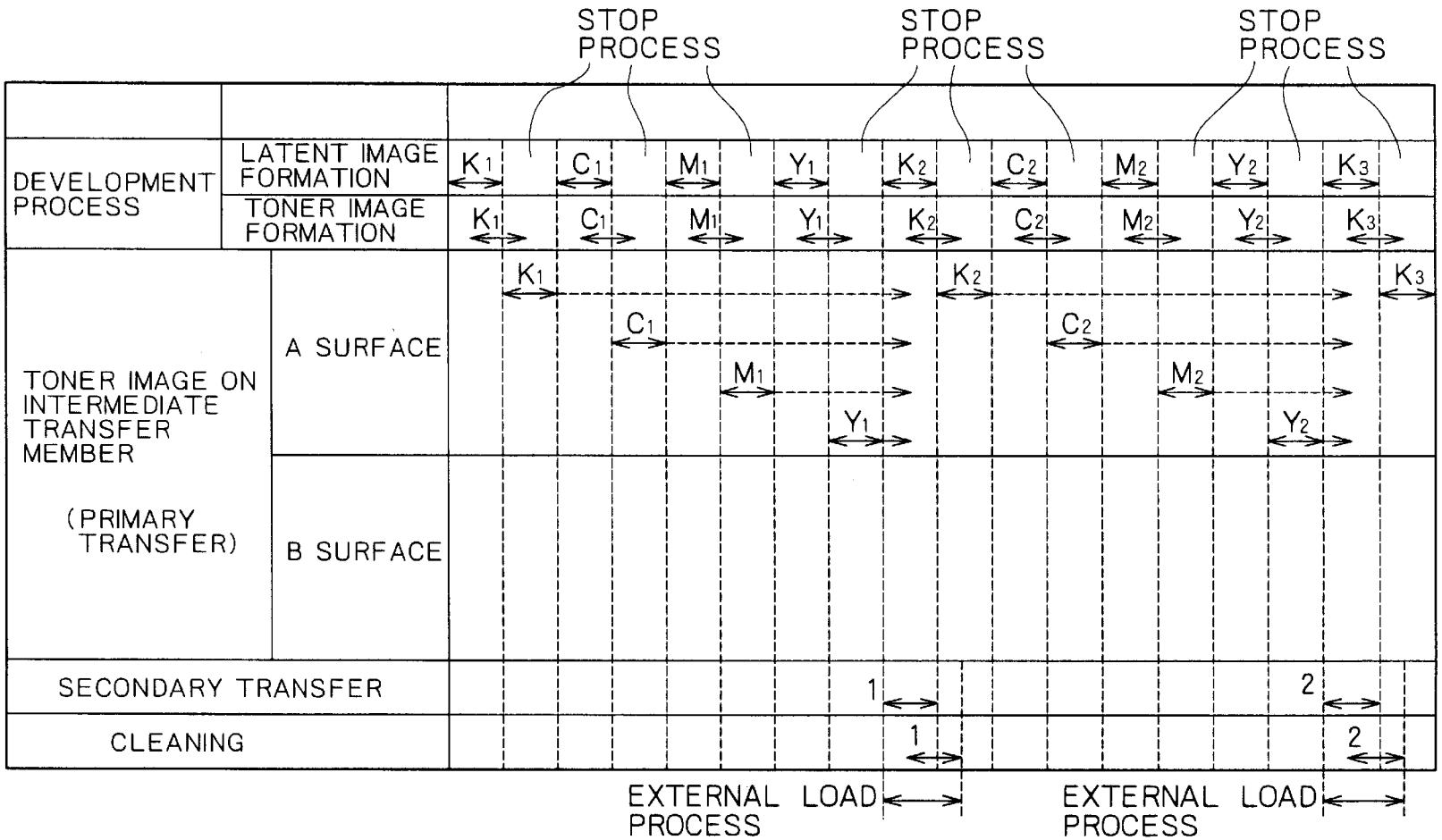
FIG. 4 is a time chart of a high quality mode when an image is formed by the color image forming apparatus of FIG. 1.
Figure 5:
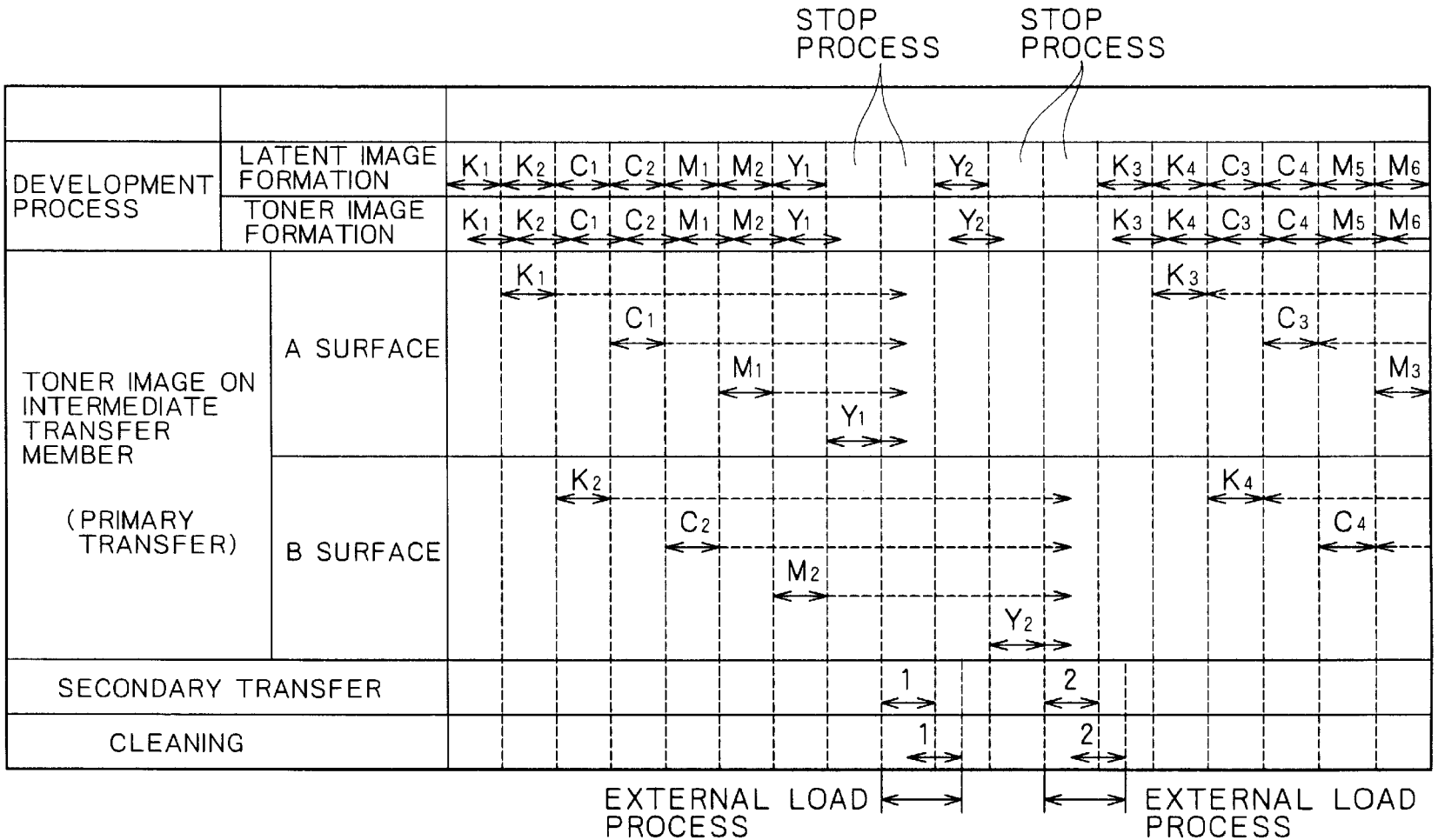
FIG. 5 is a time chart of a high speed and high quality mode when an image is formed by the color image forming apparatus of FIG. 1.

FIGS. 3 to 5 respectively show time charts at the time of image formation controlled by the control unit 15 shown in FIG. 1 according to one embodiment of the present invention.

In FIGS. 3 to 5, the development process is divided into two parts, latent image formation and toner image formation. As shown in FIGS. 3 and 5, where a recording media 11 which is smaller than one half of the longest image length capable of forming a color image is continuously subject to color image formation, a portion of the size as large as two recording media 11 can be subject to image formation on the intermediate transfer member 6, thereby doubling the print speed. The continuous image formation according to the present invention includes also a stop time when it is less than the image length, that is, the time during which an image is not being formed.

FIG. 3 shows a time chart for image formation where a recording medium 11 which is smaller than one half of the longest image length capable of forming a color image is subject to continuous color formation, which is a high speed mode time chart. For continuously forming color images, latent image formation in the development process on the photosensitive belt 2 is first continuously executed in order of $K_1$, $K_2$, $C_1$ . . . , as shown in FIG. 3, and then, toner formation is executed. Next, primary transfer of a toner image on the intermediate transfer member 6 is carried out. In the primary transfer, an area of the intermediate transfer member 6 is divided into two for the sake of convenience, providing an A surface and a B surface, so that a toner image of K, is transferred to the A surface, and a toner image of $K_2$ is transferred to the B surface, after which toner images of the colors (C, M and Y) are sequentially transferred to the A surface and B surface.

Following the primary transfer, the secondary transfer as an external load process and cleaning are carried out with respect to the intermediate transfer member 6.

A first toner image of the size of one recording medium 11, and likewise, a second toner image of the size of one recording medium 11 are formed on the A surface and the B surface on the intermediate member, respectively, whereby two color images can be formed by one rotation of the intermediate transfer member 6, enabling high speed printing.

In FIG. 3, there is illustrated an example of the case where a recording medium 11 which is smaller than one half of the longest image length capable of forming a color image is subject to continuous color image formation. However, where a recording medium 11 which is smaller than one third or one fourth of the longest image length capable of forming a color image is subject to continuous color image formation, color images for three sheets or four sheets may be formed simultaneously on the intermediate transfer member 6. In this case, even higher speed printing can be performed.

FIG. 4 shows a time chart for image formation in the case of forming a color image of high quality on a recording medium 11 which is smaller than one half of the longest image length capable of forming a color image, which is a time chart in a high quality mode. As shown in FIG. 4, a stop process (a portion not indicated by both arrows in the development process in FIG. 4) is incorporated in the midst of the development process, in other words, between the development process and the next development process, so that a color image of size of only one sheet of the recording medium 11 is formed on the intermediate transfer member 6 irrespective of the length of the recording medium 11.

Thereby, generally, the primary transfer of the next page can be carried out after completion of the secondary transfer and cleaning. In this image forming process, no influence of the external load appears on the primary transfer to the next page to enable reduction of color deviation. Needless to say, the primary transfer of the next page can be carried out after completion of the secondary transfer and cleaning by adjusting the position of the cleaner 9 and the position of the transfer roller 7. The same is true for FIG. 5.

FIG. 5 is a time chart for forming an image, where a recording medium 11 which is smaller than one half of the longest image length capable of forming a color image, can be subject to high speed printing, and a color image of high quality is formed, which is a time chart in a high speed and high quality mode.

As shown in FIG. 4, where a recording medium which is smaller than one half of the longest image length capable of forming a color image is subject to continuous color image formation, color image formation of the size of two sheets of the recording medium 11 can be carried out simultaneously on the intermediate transfer member 6.

A stop process is incorporated prior to the development process with respect to color $Y_2$ for the last image formation on and after the second page and with respect to the color $K_3$ for the first image formation on and after the third page, whereby the timing for the image formation is deviated, and latent image formation of colors (Y2 and K3 in FIG. 4) for image formation and the primary transfer are carried out after completion of the secondary transfer of the previous page and cleaning.

With this, the influence of the external load, such as the latent image formation and the primary transfer, is not brought about, thereby to enable reduction of color deviation, and a color image with higher speed printing and higher quality than the case of FIG. 4 can be formed.

Also, in the image forming process in FIG. 5, a description has been made of the case where the recording medium 11, which is smaller than one half of the longest image length capable of forming a color image, is subject to continuous color image formation, similarly to FIG. 3 However, where a recording medium 11 which is smaller than one third or one fourth of the longest image length capable of forming a color image is subject to continuous color image formation, color images for three sheets or four sheets may be formed simultaneously on the intermediate transfer member 6.

Also, in this case, similar to the case of simultaneous image formation for two sheets, a stop process is incorporated prior to the development process with respect to image formation of the final color of images on and after the second sheet, and with respect to the color for first image formation of the next simultaneous image formation (in case of three sheets at the same time, the color of the first image formation of the fourth sheet, and in case of four sheets at the same time, the color of the first image formation of the fifth sheet), whereby timing for the image formation is deviated, and generally, the latent image formation for image formation and the primary transfer are carried out after completion of the secondary transfer of the previous page and cleaning, to thereby obtain an effect equivalent to that of the case for simultaneous image formation for two sheets.

In the color image formation, three kinds of image forming processes of FIGS. 3, 4 and 5 mentioned above are characterized in that a relation of FIG. 3>FIG. 5>FIG. 4 in the printing speed, and a relation of FIG. 4>FIG. 5>FIG. 3 in the high quality are established, because of which the aforementioned three kinds of image forming processes can be switched according to demand to provide a color image forming apparatus of high speed, high quality and high speedand high quality.

Where, in the color image forming apparatus according to the present embodiment, a recording medium smaller than one half of the longest image length capable of forming a color image is subjected to continuous monochromatic image formation, superposing of toner images is not carried out, a plurality of monochromatic images can be simultaneously formed on the intermediate transfer member, and high speed printing can be carried out.

As described above, there are provided both a high quality mode for reducing color deviation of an image caused by the influence of a variation in load of an intermediate transfer member to suppress deterioration of image quality and a high speed mode capable of providing high speed printing, to thereby enable provision of a color image forming apparatus of high quality and also capable of performing high speed printing, which can widely cope with the demands of the marketplace.

What is claimed is:

1. A color image forming apparatus comprising:

a photosensitive member;

an exposure unit for exposing images of colors to said photosensitive member to form a latent image;

a plurality of development units for developing the latent image formed on said photosensitive member by a toner of a corresponding color to form a plurality of toner images;

an intermediate transfer member in which said formed toner images are repeatedly subject to primary transfer to form a color image; and a transfer member for causing said formed color image to be secondary-transferred to a surface of a recording medium;

wherein, for a recording medium having a size smaller than one half of the longest image length capable of forming a color image which is continuously subject to image formation, two modes are set including a first mode of continuously carrying out a developing process for forming a latent image and a toner image and a second mode of employing a stop process for stopping the developing process in the midst of the developing process.

2. The color image forming apparatus of claim 1, wherein said first mode is a high speed mode for carrying out the primary transfer of the next page of the recording medium during the secondary transfer of the previous page and cleaning, and said second mode is a high quality mode for carrying out the primary transfer of the next page of said recording medium after the secondary transfer of the previous page and cleaning.

3. The color image forming apparatus of claim 2, wherein in said high speed mode, a plurality sheets of color images of a size of said recording medium are formed on said intermediate transfer member, and in said high quality mode, a sheet of color image of size of said recording medium is formed on said intermediate transfer member.

4. The color image forming apparatus of claim 1, wherein said second mode is a high speed and high quality mode for carrying out color image forming for a plurality of sheets of a size of said recording medium on the intermediate transfer member, deviating a timing of an image forming time of a color for forming an image at last on and after second page of said recording medium, and deviating and carrying out latent image formation of a color for forming an image of the next page at last and the primary transfer after completion of the secondary transfer of the previous page and cleaning.

* * * * *